US010888911B2

(12) United States Patent
Nillies

(10) Patent No.: US 10,888,911 B2
(45) Date of Patent: Jan. 12, 2021

(54) FORMING MACHINE FOR SPINNING/FLOW FORMING AND METHOD FOR SPINNING/FLOW FORMING

(71) Applicant: Leifeld Metal Spinning AG, Ahlen (DE)

(72) Inventor: Benedikt Nillies, Ahlen (DE)

(73) Assignee: Leifeld Metal Spinning AG, Ahlen (DE)

( * ) Notice: Subject to any disclaimer, the term of this patent is extended or adjusted under 35 U.S.C. 154(b) by 568 days.

(21) Appl. No.: 15/545,853

(22) PCT Filed: Jul. 27, 2016

(86) PCT No.: PCT/EP2016/067899
§ 371 (c)(1),
(2) Date: Jul. 24, 2017

(87) PCT Pub. No.: WO2017/067682
PCT Pub. Date: Apr. 27, 2017

(65) Prior Publication Data

US 2018/0015518 A1 Jan. 18, 2018

(30) Foreign Application Priority Data

Oct. 20, 2015 (EP) ..... 15190545

(51) Int. Cl.
*B21D 22/16* (2006.01)

(52) U.S. Cl.
CPC ..... *B21D 22/16* (2013.01)

(58) Field of Classification Search
CPC ..... B21D 22/14; B21D 22/16; B21D 22/18; B23Q 2210/004; B23Q 2220/006
See application file for complete search history.

(56) References Cited

U.S. PATENT DOCUMENTS 2,975,743 A * 3/1961 Hoffmann ..... B21D 22/16 72/7.3
2,995,170 A * 8/1961 Donato ..... B21D 19/00 72/21.3

(Continued)

FOREIGN PATENT DOCUMENTS

DE 30 41 267 A1 8/1982
DE 10 2005 004 236 A1 8/2005

(Continued)

OTHER PUBLICATIONS

An Office Action mailed by the Japanese Patent Office dated Sep. 25, 2018, which corresponds to Japanese Patent Application No. 2017-546692 and is related to U.S. Appl. No. 15/545,853.

(Continued)

*Primary Examiner* — Edward T Tolan
(74) *Attorney, Agent, or Firm* — Studebaker & Brackett PC

(57) ABSTRACT

The invention relates to a forming machine for the spinning/flow forming of a workpiece, having a machine bed, a headstock, a main spindle rotatably mounted on the headstock, having a flow forming mandrel, which is provided to receive the workpiece, a support, which carries at least one machining tool, and which is axially displaceable relative to the main spindle in a longitudinal direction of the machine bed. Furthermore a main spindle drive for driving the main spindle in rotation and a feed drive for displacing the support are provided. The main spindle drive has at least two drive motors, each having a drive pinion. The main spindle has a driving gear, which can be driven by the drive pinions of the drive motors.

20 Claims, 6 Drawing Sheets

(56) References Cited

U.S. PATENT DOCUMENTS

| | | | | |
|---|---|---|---|---|
| 3,035,463 | A * | 5/1962 | Stalker | B21H 1/02 72/10.1 |
| 3,956,914 | A * | 5/1976 | Prochaska | B21D 22/14 72/80 |
| 4,729,232 | A * | 3/1988 | Hillier | B21H 5/027 72/481.4 |
| 4,893,514 | A | 1/1990 | Gronert et al. | |
| 4,976,126 | A * | 12/1990 | Yamamoto | B21D 22/16 72/81 |
| 5,598,729 | A * | 2/1997 | Hoffmann | B21D 22/18 72/10.4 |
| 6,253,589 | B1 * | 7/2001 | Putz | B21D 22/16 29/893.32 |
| 6,311,591 | B1 * | 11/2001 | Grossmann | B23Q 1/5406 29/27 C |
| 6,386,010 | B1 | 5/2002 | Irie et al. | |
| 7,131,304 | B2 * | 11/2006 | Arai | B21D 22/16 72/82 |
| 8,479,549 | B1 | 7/2013 | Fonte | |
| 8,692,495 | B2 * | 4/2014 | Berger | B02C 25/00 100/121 |
| 2003/0046803 | A1 | 3/2003 | Kaneko | |
| 2008/0216539 | A1 * | 9/2008 | Meinig | B21D 19/046 72/86 |
| 2009/0288464 | A1 * | 11/2009 | Kostermeier | B21D 22/16 72/84 |
| 2016/0207157 | A1 * | 7/2016 | Corletto | B23Q 17/22 |

FOREIGN PATENT DOCUMENTS

| | | | |
|---|---|---|---|
| EP | 0 611 612 | A1 | 8/1994 |
| FR | 2 619 915 | A1 | 3/1989 |
| JP | S50-056684 | A | 5/1975 |
| JP | S58-160037 | A | 9/1983 |
| JP | H02-020626 | A | 1/1990 |
| JP | H02-311235 | A | 12/1990 |
| JP | 2000-351022 | A | 12/2000 |
| JP | 2001-252844 | A | 9/2001 |
| JP | 2003-048024 | A | 2/2003 |
| JP | 2005-297041 | A | 10/2005 |
| JP | 2009-285730 | A | 12/2009 |

OTHER PUBLICATIONS

International Search Report issued in PCT/EP2016/067899; dated Feb. 16, 2017.

International Preliminary Report on Patentability and Written Opinion issued in PCT/EP2016/067899; dated Apr. 24, 2018.

* cited by examiner

FORMING MACHINE FOR SPINNING/FLOW FORMING AND METHOD FOR SPINNING/FLOW FORMING

The invention relates to a forming machine for spinning/flow forming of a workpiece, having a machine bed, a headstock, a main spindle rotatably mounted on the headstock and having a flow forming mandrel, which is provided to receive the workpiece, having a support which carries at least one machining tool, and which can be axially displaced relative to the main spindle in a longitudinal direction of the machine bed, a main spindle drive for driving in rotation the main spindle and a feed drive for displacing the support.

The invention further relates to a method for spinning/flow forming of a workpiece, wherein the workpiece is arranged on a flow forming mandrel fixed to a main spindle, the main spindle is driven by one or more main spindle drives, and a support, on which at least one machining tool is arranged, is moved relative to the flow forming mandrel for the spinning/flow forming of the workpiece.

Spinning and flow forming are chipless forming methods, wherein a mostly rotationally symmetrical workpiece (blank) is pressed or elongated with a predefined contour by one or more spinning rollers or flow forming rollers lying against its outer circumferential surface via a flow forming mandrel set in rotation. During the machining an axial feed of the spinning rollers with respect to the workpiece takes place. The workpiece is pressed against the outer contour of the flow forming mandrel and contoured to a desired contour, wherein a reduction of the wall thickness can also take place (flow forming). Within the said forming method also the so called flow turning method or spin flow turning method have to be understood.

A generic spinning machine follows for example from DE 30 41 267 A1.

In known spinning or flow forming machines, the main spindle is driven by a main spindle motor via a v-belt, a gear or a toothed belt drive. Drive powers of up to 300 kW can thereby be used. Torques of up to approximately 40,000 Nm can be achieved via a plurality of shifted gears in the head assembly.

Such drives have the disadvantage that shifted gears are cost-intensive and the degree of efficiency is impaired by frictional losses within the shifted gears. Expensive lubricating and cooling systems are usually installed.

In the case of large workpieces to be machined and in the case of large reductions in wall thickness, considerable powers must be applied for forming. In particular, considerable powers are required to rotate the flow forming mandrel and to feed the support, on which the machining tools, in particular spinning rollers, are arranged. There are upper power limits in known drives of the flow forming mandrel and the support.

It is the object of the invention to indicate a forming machine for spinning/flow forming of a workpiece and a corresponding method, which are suitable for the provision of high forming powers and for machining large workpieces, wherein the design of the forming machine is as simple as possible.

This object is achieved on the one hand by means of a forming machine having the features discussed below, on the other hand by means of a forming machine having the features discussed below. Furthermore the object is achieved by means of a method according to present invention.

Preferred embodiments are indicated in the respective sub-claims.

A forming machine according to the invention is characterised in that the main spindle drive has at least two drive motors, each having a drive pinion, and that the main spindle has one or more driving gears, which can be driven by the drive pinions of the drive motors.

A core idea of the invention can be seen in providing the power to drive the main spindle by means of a plurality of drive motors. A plurality of smaller motors can therefore be provided for the provision of high torques which motors are commercially available in greater quantities and may thus be more cost-effective.

An advantage of the forming machine according to the invention is that a driving torque (total driving torque) acting on the driving gear of the main spindle is divided into a plurality of, in particular two, partial driving torques. Instead of being subjected to a punctual, high total load, therefore, the driving gear can be subjected to a plurality of clearly lower, partial loads. The point loading of the driving gear can hereby be clearly reduced. As a result, for example the requirements on the material or the dimensions of the gearwheel can be reduced and thus costs can be spared.

A further core idea of the invention is to operate the at least two drive motors in parallel. For this, the driving gear provided on the main spindle is driven simultaneously by the drive pinions assigned to the drive motors to drive the main spindle.

According to the invention it is particularly preferred that the drive pinions and/or the drive motors are arranged symmetrically to the driving gear of the main spindle. A symmetrical arrangement is hereby to be understood in particular as an arrangement with drive pinions and drive motors that are equidistant relating to the driving gear. It can also be understood to mean a rotationally symmetrical arrangement with respect to a rotation axis of the driving gear. With two drive pinions or drive motors, these are accordingly offset by 180° relative to each other, in the case of three, by 120° relative to each other, etc. Through the symmetrical arrangement, the driving gear is unloaded as much as possible. Through the offset arrangement of the drive pinions and drive motors, the individual torques of the drive motors are generated at different points of the driving gear. Through a master-slave operation, an even torque load of the individual motors is ensured. This has the advantage that the gearwheel width and thus also the gearwheel weight and the therewith associated centrifugal moment ($GD^2$) or the moment of inertia of the forming machine are substantially reduced. This has a positive effect, inter alia, on the acceleration and slowing down of the machine.

A particularly preferred embodiment is characterised in that the drive pinions are each arranged on a motor output shaft of the corresponding drive motor, and the drive pinions are directly in engagement with the driving gear of the main spindle. In this arrangement of the drives, an exact speed synchronisation is produced. In one exemplary embodiment a gear ratio i of 1:10 is reached, which can result in a spindle speed of 0 to 200 $min.^{-1}$. In the case of a spindle speed of 0 to 50 $min.^{-1}$, a constant torque of approximately 50,000 Nm is reached. Torques of over 100,000 Nm can also be realised. The direct coupling of the drive motor and main spindle allows the omission of a plurality of shifted gears, which in general are cost-intensive and prone to wear. A particular advantage follows in that the energy usually dissipated in the gear (friction losses) is available as additional drive energy for the main spindle. The degree of efficiency of the drive according to the invention is therefore particularly good. In addition, expensive lubricating and cooling systems for lubricating and cooling a gearbox are not necessary.

It is particularly preferred according to the invention that the drive motors are designed as slow rotating motors, in particular as three-phase asynchronous motors. Such motors have a high nominal torque at low speeds. They thus offer the advantage that no speed transmission, or only a low speed transmission, is required to transmit the power from the motor output to the main spindle. In particular the transmission can be designed as a merely single-stage transmission. Gear or transmission losses can therefore be clearly minimised. Slow rotating three-phase asynchronous motors are suited in particular for the provision of large and temporally constant torques. Thus, torques of over 100,000 Nm can be realised.

A further forming machine according to the invention is characterised in that the feed drive has a plurality of drive units, which can be operated in a gantry operation. In contrast with a single, central drive unit, a plurality of drive units for driving the support has the advantage that the drive power is divided. An individual drive unit therefore only has to provide a fraction of the total drive power. The total drive power can hereby be increased in a simply manner.

In order to produce high-precision cylinder tubes, the drive units must be operated in a synchronised speed. For this, it is provided that the drive units are moved in a so-called gantry operation. In a gantry operation one or more drives, for example, synchronously follow a leading drive unit and thus ensure a symmetrical feed with partially differing driving torques.

It is particularly preferred in this connection that at least four drive units are provided. For precise machining of the workpiece it is necessary that the axial feeds, which are provided by the drive units, are introduced with great positioning precision as symmetrically as possible into the system. The axial relative movement of the flow forming mandrel to the spinning roller can be realised via a movement of the support, a movement of the main spindle via the headstock or by a combination of both. The headstock can also be described as a head assembly. It has thereby been shown that four drive units facilitate a particularly reliable and precise introduction of the feed forces into the support or the headstock with the main spindle. A special regulating technology ensures the necessary synchronisation of the drive units.

With respect to the required synchronous introduction of the feed forces, it is particularly preferred that the drive units are designed identically. An identical design of the drive units additionally has the advantage that storage and repair costs of the drive units can be reduced.

In order to reduce as far as possible tilt moments on the support or the headstock during axial movement, it is provided according to a preferred embodiment that the drive units are arranged symmetrically around a machine axis of the forming machine. A machine axis is to be understood in particular to be an axis which runs through a rotation axis of the main spindle. The axis also forms the centre of symmetry of the forces acting on the support through the machining of the workpiece. Such a symmetrical arrangement of the drive units thus supports a reliable guiding of the support or the headstock on the machine bed.

An advantageous embodiment of the forming machine according to the invention is characterised in that the drive units each have a ball screw spindle and that the ball screw spindles are arranged parallel to each other. Ball screw drives are suited, through their high precision, for the exact positioning of the support. Four ball screw drives are preferably provided, which are synchronised via a gantry system. By means of a CNC controller the drives are operated with rotation angle synchronisation or positional accuracy. Alternatively, a drive with a planetary roller screw drive can also be provided.

In particular in the context of particularly long ball screws it is provided according to a preferred embodiment that at least one ball screw spindle is designed in multiple parts, in particular in two parts, that a first part of the ball screw spindle is arranged in a loaded work area and a second, smaller part of the ball screw spindle in an unloaded work area, and that the second part of the ball screw spindle can be pre-stressed for supporting the first part of the ball screw spindle. A loaded work area is hereby understood in particular to be an area between the headstock and the support. The second part of the ball screw spindle has the function of a support or brace. The support of the first part is achieved by pre-stressing of the second, unloaded part.

Furthermore it is preferred that, for position control and/or position regulation of the support, a rotary encoder/measuring system is arranged on the second part of the ball screw spindle. Rotary encoders/measuring systems, also known as incremental encoders, facilitate a high-precision detection of position changes, which can detect both the distance and also the direction of the route.

For the machining of particularly long workpieces, the ball screw spindles must have a long length. In an advantageous embodiment of the invention it is therefore provided that, to support at least one ball screw spindle, a calotte support is provided. Through such a support, sagging of the ball screw spindle is reduced. This leads to a more precise feeding and a more precise guiding of the support. The quality of the workpiece machining can therefore be increased. Thus, the design as a calotte support is advantageous because this causes low friction and can be favourably produced.

The calotte support can be designed as a co-moving or also as a continuous calotte support. Alternatively, a system with rotating nut and pre-stretched (pre-stressed) spindle can also be used, in order to increase the positioning precision of the support.

Due to the high torque, a tool holder as referred to in DIN 55027 is provided on the main spindle to receive a flow forming mandrel of the size 20 or larger, in a strengthened design—in contrast with the usual and known size 15. To transmit high torques it is provided according to a further preferred embodiment of the invention that the main spindle transmits the torque in a positive locking manner to the flow forming mandrel. The positive locking connection between the flow forming mandrel and main spindle can be provided in particular additionally to a frictionally engaged connection. For the frictionally engaged connection, the tool holder provided on the main spindle is formed as a conical holder.

A particularly preferred embodiment of the positive locking connection is provided in that the positive locking connection between the flow forming mandrel and main spindle is realised as a Hirth teeth system. This is located both at the end face of the tool holder and also at the end face of the flow forming mandrel. Through the Hirth teeth system, the combination of a positive locking and a frictionally engaged connection can be realised in a particularly advantageous and reliable way.

In order to hold the flow forming mandrel securely on the main spindle, even at high torques, it is preferred that an ejecting means with a push button or a rotary feed and a tailstock with a contact pressure extension are provided, by means of which the flow forming mandrel can be tensioned onto the main spindle. Through axial forces respective of the ejecting means with the push button/rotary feed and the tailstock with the contact pressure extension, the flow forming mandrel can be tensioned onto a cone of the tool holder and be securely held during forming with high torques. When changing workpieces, the flow forming mandrel can also be held in this way.

In a further advantageous embodiment of the invention a tailstock is provided with a tailstock spindle, a rotational speed synchronisation can be set between the main spindle and tailstock spindle, and this rotational speed synchronisation can be converted to a torque-controlled operation. Particularly high forming powers can hereby be achieved. The machine is preferably driven in torque-controlled operation. Through driven spinning rollers or flow forming rollers, the torque made available can be further increased during the forming process. The peripheral speed of the roller is preferably synchronised with the machining diameter.

According to a refinement of the invention it is preferred that spinning rollers and/or radial units of the support are mounted to be adjustable relative to each other, and that the spinning rollers and/or the radial units can be adjusted axially under load by means of an actuator. A plurality of rollers or radial units are mounted to be linearly adjustable in the support. The adjustability is preferably in the axial direction but can also be provided in the radial direction. The radial units are bearing elements, in which the spinning rollers are rotatably mounted. By means of corresponding actuators, which can have linear drives, the individual rollers or radial units can be adjusted and justified relative to each other. Thereby, at least one radial unit can be indirectly supported via a stabilisation frame. The adjustment is preferably realised under load, thus in the ongoing forming operation, so that very precise forming can be achieved.

The method according to the invention for spinning/flow forming of the workpiece is characterised in that the main spindle drive has at least two drive motors, each with a drive pinion, and that the main spindle has a driving gear, which is driven through the drive pinions of the drive motors. Through this type of drive, particularly high torques can be provided, as described in association with the forming machine according to the invention.

In a preferred embodiment of the method, the support and/or the headstock are moved by means of a plurality of drive units which are operated in a gantry system. Here also, the advantages indicated in association with the corresponding forming machine are produced.

The invention will be described in greater detail below using the attached schematic drawings, in which.

Figure 1:
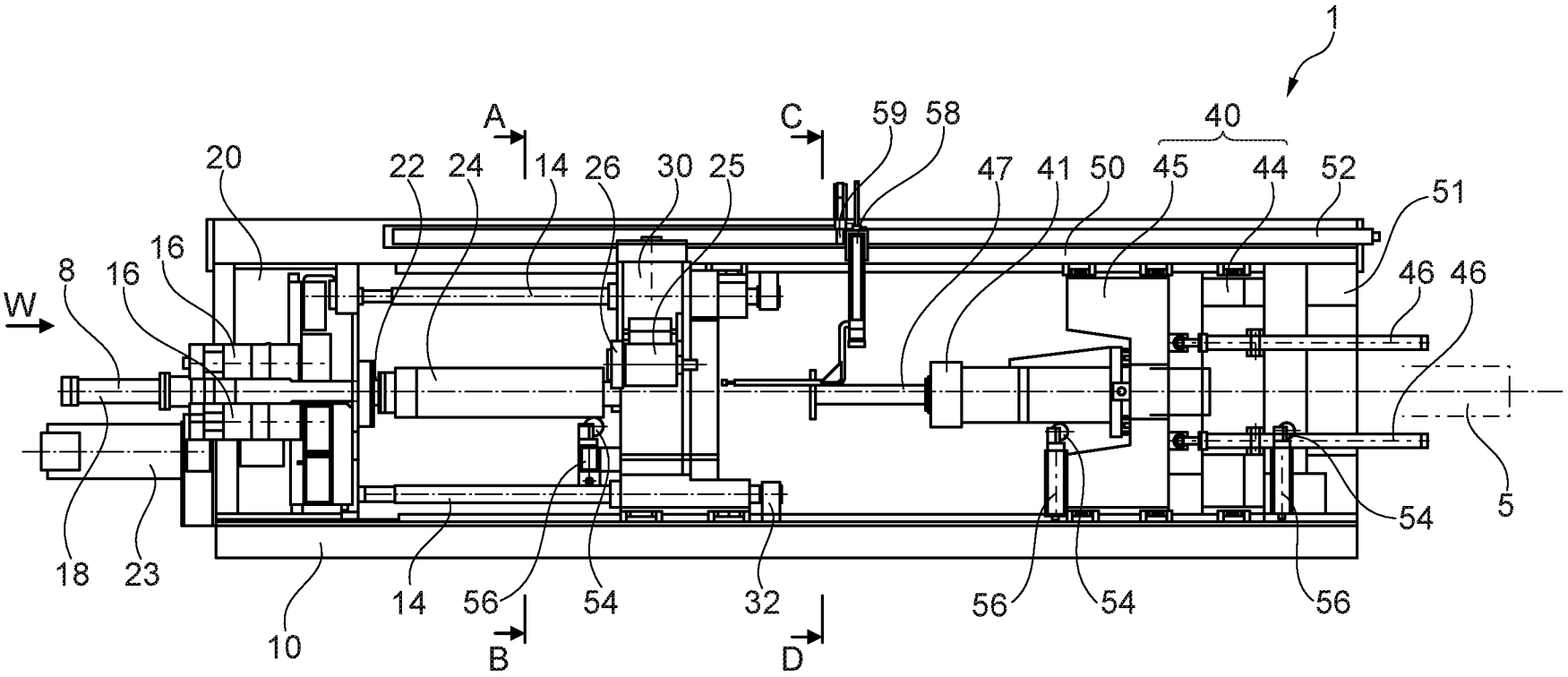
FIG. 1 shows a schematic side view of a forming machine according to the invention as seen from an operator side.

FIGS. 1 to 5 show a forming machine 1 according to the invention in different views. The forming machine 1 has a machine bed 10 with a headstock 20 mounted thereon. The headstock 20, which can also be described as a head assembly, is mounted so that it is fixed or axially movable. Furthermore on the machine bed 10, a support 30 is displaceably guided parallel to a machine axis 8 of the forming machine. In the longitudinal direction, as seen from the headstock 20, behind the support 30 there is a tailstock 40, which has in the embodiment shown a first tailstock body 44 and a second tailstock body 45. The first tailstock body 44 and second tailstock body 45 are coupled to each other via a feed means 46. The tailstock 40 can, however, also be formed in one part. In the case of an axially displaceable head assembly, the tailstock 40 is preferably displaceably coupled to the headstock 20. Forcing-out or driving-out of the tailstock 40 is thereby avoided, whereby a particularly efficient forming is possible.

To increase the stability of the forming machine 1, of which the loads significantly increase with increasing size of the workpiece, a cross-beam 50 is provided above the machine bed 10 substantially parallel to the machine axis 8 and to a longitudinal direction of the machine bed 10. This cross-beam 50 extends substantially over the whole length of the machine bed 10. At least at one end the cross-beam 50 is fixedly connected via at least one cross-beam support 51 to the machine bed 10. In a design with fixed headstock 20, this can serve as a cross-beam support.

On the headstock 20, a main spindle 22 is in a rotatably mounted manner arranged. On the main spindle 22 there is a flow forming mandrel 24 to receive a workpiece 5 to be formed. In its non-machined form (blank), the workpiece 5 to be formed is preferably a cylindrical body without a base, which can also be described as a cylinder tube or cylinder sleeve.

The main spindle 22 is driven in rotation by a main spindle drive 23. The main spindle drive 23 has, in the embodiment shown, two drive motors 23*a* and 23*b*, which are arranged at equal distance from the machine axis 8. The drive motors 23*a* and 23*b* are located below the machine axis 8 and mirror-symmetrically to a vertical machine centre plane 9, which runs through the machine axis 8. The machine axis 8 constitutes in particular a longitudinal axis of the forming machine 1, which runs through a rotation axis of the main spindle 22.

To machine the workpiece 5 pushed onto the flow forming mandrel 24, a plurality of machining tools 26 are fixed to the support 30 above the tool carrier 25. The machining tools 26 are formed as spinning rollers or flow forming rollers and are brought into engagement with the periphery of the workpiece 5 through feeding in the spindle radial direction. Through the thus applied forces, a cold forming process of the workpiece 5 takes place. In addition to the radial feeding, an axial feed of the spinning rollers and respectively the flow forming rollers takes place. For this, the support 30 in the illustration shown in FIG. 1 is moved to the left and the formed material flows in a so-called counter-movement process to the right, and in a so-called co-movement process to the left. On the support 30, three machining tools 26, each offset by 120°, are arranged. Four machining tools 26, each offset by 90°, can preferably be provided, which facilitate an even better force distribution.

For the axial movement of the support 30, a feed drive is provided. This has four drive units in the embodiment shown. The drive units are designed as ball screw drives, which can be operated in the so-called gantry system. Through the co-movement of the drive units hereby achieved it is ensured that the drive units bring the feeds symmetrically into the support.

A drive unit has in each case a ball screw spindle 14 and a ball screw spindle drive 16. Each two opposing ball screw spindles 14 with their corresponding ball screw spindle drives 16 are arranged rotationally symmetrically around the machine axis 8. All drive units are at the same distance from the machine axis 8. As seen in cross-section (see FIG. 2), the ball screw spindles 14 are located in an upper and lower region of the forming machine 1, wherein each two ball screw spindles 14 are arranged mirror symmetrically to the machine centre plane 9. The ball screw spindle drives 16 are concentrated, in vertical terms, in an approximately central area to the side of the machine axis 8. Each two ball screw spindle drives 16 are thereby arranged mirror symmetrically to the machine centre plane 9.

In the exemplary embodiment, four screw spindle drives with a total of 3000 kN feed force are used. In order to produce, for example from a steel liner with 50 mm wall thickness and 3000 mm length, a cylinder tube with 12 m length and with an end wall thickness of 12.5 mm, it is provided to carry this out in one to two overflows each with a wall thickness reduction of 50% and more. Such stretching lengths were not possible with single-part ball screw drives or planetary roller screw drives, known to date, in the required size and precision.

To detect the position of the support 30, a measuring system/rotary encoder 32 is provided. The precise position determination that can be achieved by this is suitable for improving the position control or position regulation of the support 30.

To detect the length of a workpiece 5 rolled in the counter-movement process during the forming, the forming machine 1 is equipped with a stretching length detection measurement system 58. The stretching length detection measurement system 58 has a measurement carriage 59, which carries a compact module and is guided longitudinally displaceably on a track 52 along the cross-beam 50.

Figure 2:
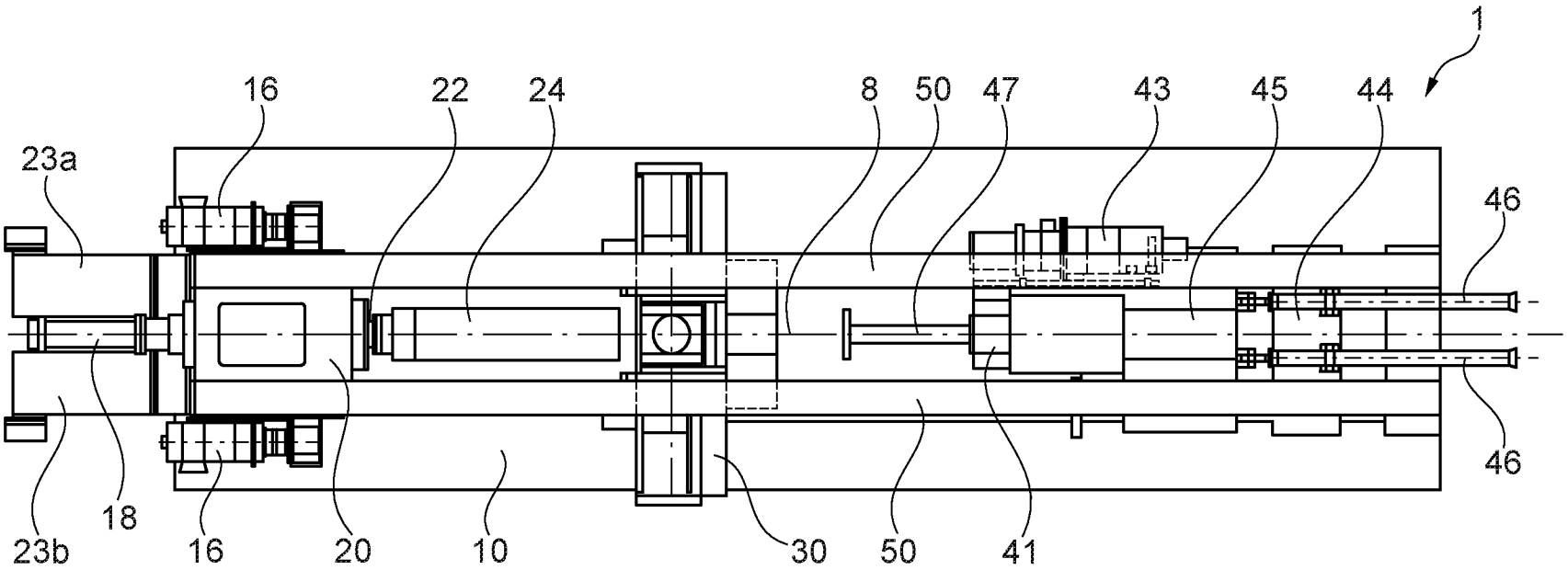
FIG. 2 shows a schematic view from above of the forming machine shown in FIG. 1.

The tailstock 40 has in this exemplary embodiment a first tailstock body 44 and a second tailstock body 45. On the second tailstock body 45, in extension of the main spindle 22, at the level of the machine axis 8, a tailstock spindle 41 with a tool holder, in particular for a contact pressure extension 47, is arranged in a rotatably mounted manner. The tailstock spindle 41 is driven by a preferably identical spindle drive as also used for the main spindle 22. A cost-effective storage is hereby achieved. A tailstock spindle drive 43 is shown in FIG. 2.

The flow forming mandrel 24 is rotationally securely fixed, in particular by an axial Hirth toothing, to the main spindle 22. By moving the tailstock 40, in particular the second tailstock body 45, the tailstock spindle 41 and respectively the contact pressure extension 47 can be pressed axially against the flow forming mandrel 24 and respectively the workpiece 5 (cylinder tube). An axial and radial contact force can be adjusted corresponding to the requirements. It is hereby ensured that a secure positive locking connection is guaranteed between the main spindle 22 and flow forming mandrel 24 also during the forming process at high torques.

To eject the flow forming mandrel 24 and/or the workpiece 5, an ejecting means 18 is provided on the headstock 20. The ejecting means 18 is equipped with a push head and can be used, in association with the contact pressure extension 47, additionally to tension the flow forming mandrel 24 onto the main spindle 22 and—also with high torques—hold it securely thereon. The ejecting means 18 can also be used for other additional functions, for example to activate displacement or spreading tools.

To support the flow forming mandrel 24, the tailstock spindle 41 and/or the workpiece 5, a plurality of support means 56 can be provided with roller bodies 54, which are suitable for taking up axial and radial rotation movements. In the case of large workpiece diameters, the support means 56 can be omitted.

Figure 5:
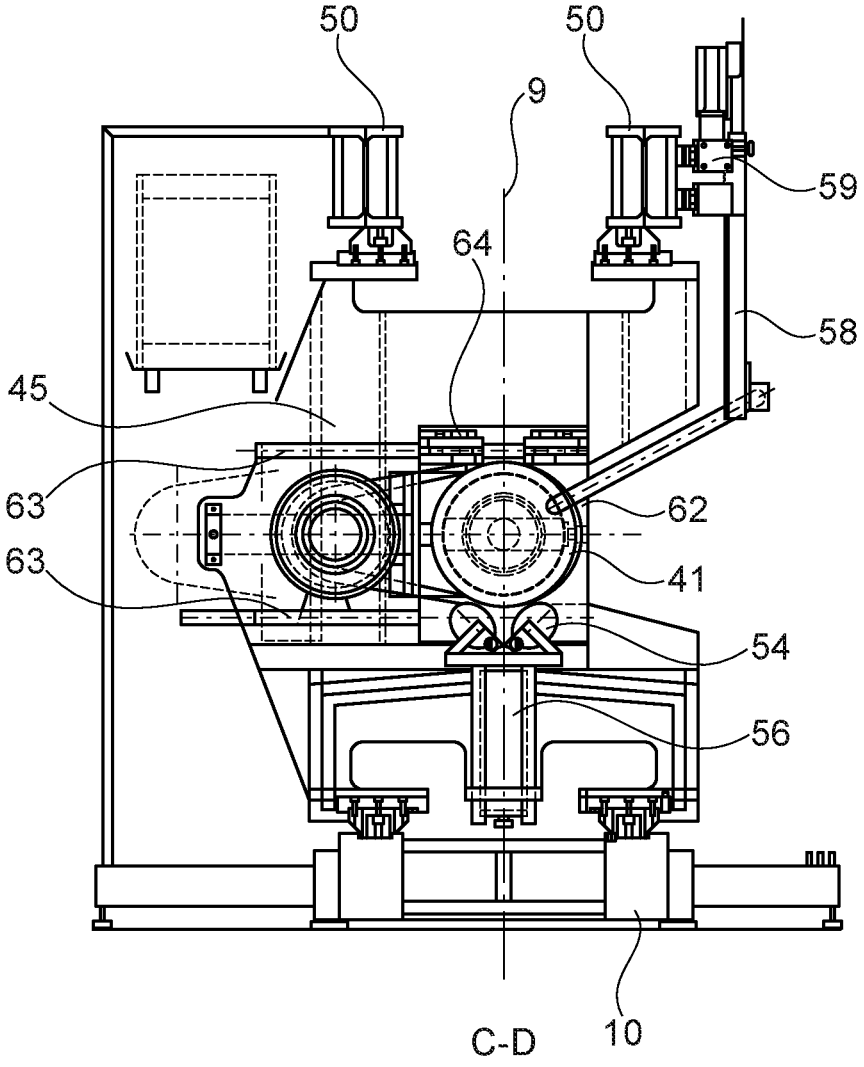
FIG. 5 shows a cross-sectional view of the forming machine shown in FIG. 1 along the intersecting line C-D.

FIG. 2 and FIG. 5 show the forming machine 1 shown in FIG. 1 in a view from above. In order to provide a passage area for the workpiece 5 through the tailstock 40, it is indicated that the tailstock spindle 41, the contact pressure extension 47 and the tailstock spindle drive 43 can be moved radially to the machine axis 8 into a side area of the forming machine 1.

Figure 3:
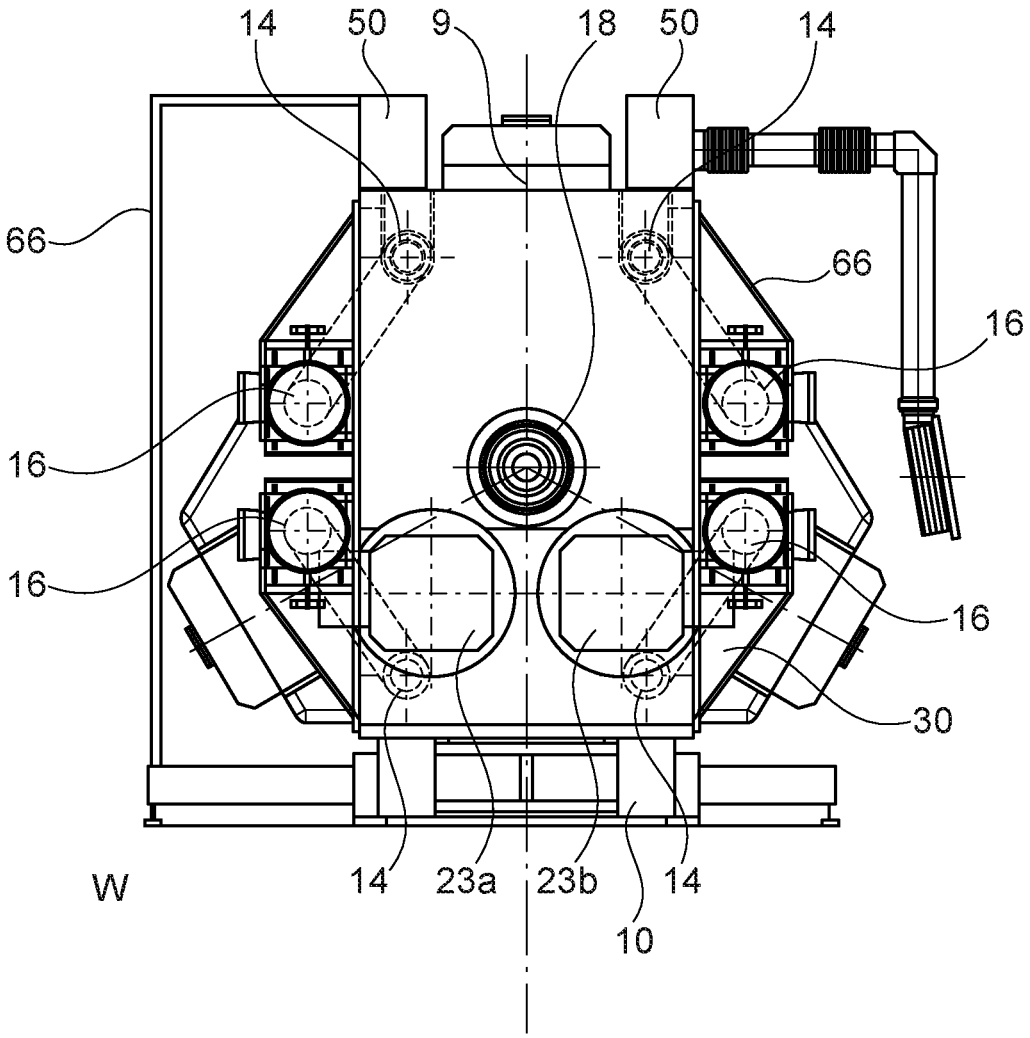
FIG. 3 shows a front view of the forming machine shown in FIG. 1.

FIG. 3 shows a front view of the forming machine 1. To prevent the exit of cool emulsion, an enclosure 66 of the work space is provided.

Figure 4:
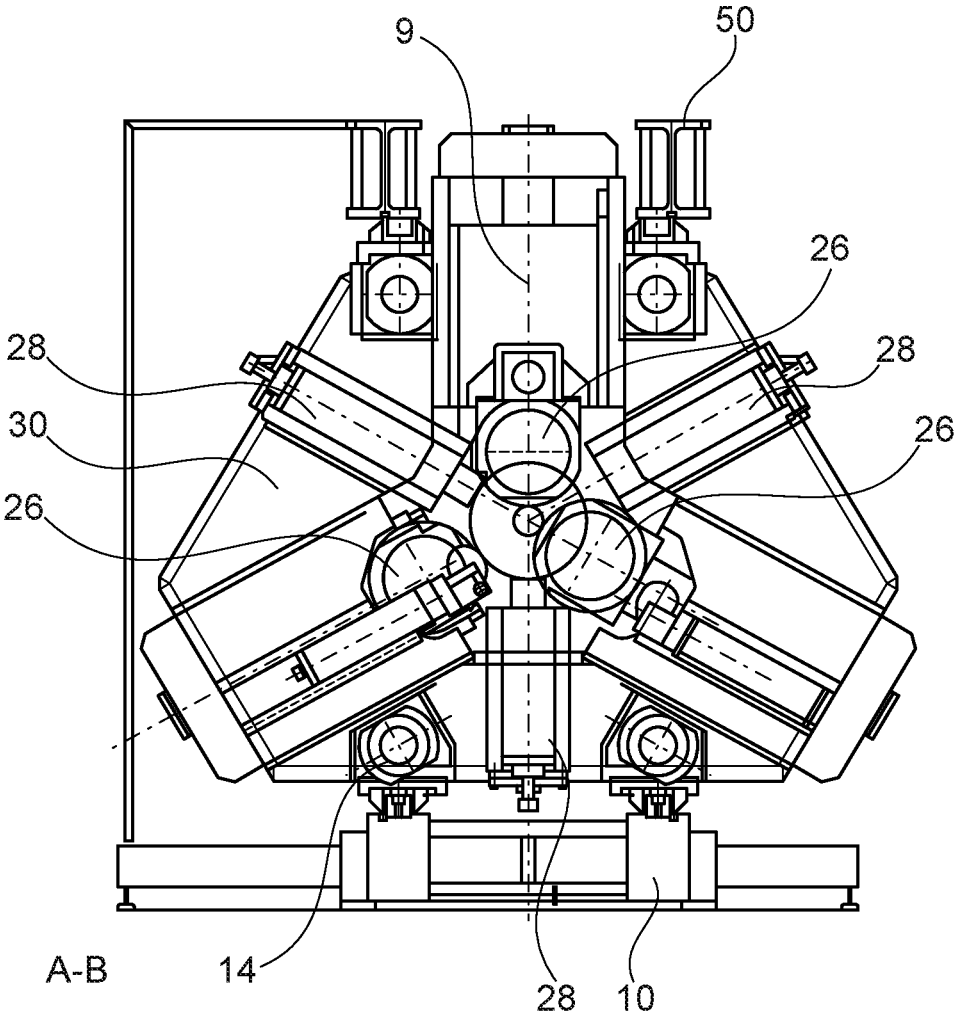
FIG. 4 shows a cross-sectional view of the forming machine shown in FIG. 1 along the intersecting line A-B.

FIG. 4 shows a cross-sectional view of the forming machine 1 along the intersecting line A-B of FIG. 1. Three machining tools 26 in the form of spinning rollers or respectively flow forming rollers are arranged, each offset by 120° relative to each other, around the flow forming mandrel 24. On the support housing, three stripper devices 28 are arranged for stripping the completely machined workpiece 5 from the flow forming mandrel 24, also each offset by 120° relative to each other. Through the symmetrical arrangement of the stripper devices 28, tilting of the workpiece 5 during stripping from the flow forming mandrel 24 is prevented.

FIG. 5 shows a cross-sectional view along the intersecting line C-D of FIG. 1. The tailstock spindle 41 is arranged on a spindle carriage 62. The spindle carriage 62 can be displaced along a carriage guide 63. For this, a plurality of guide carriages or guide shoes 64 are arranged on the spindle carriage 62. The tailstock spindle 41 is moved with the spindle carriage 62 out of an area of the machine axis 8.

Figure 6:
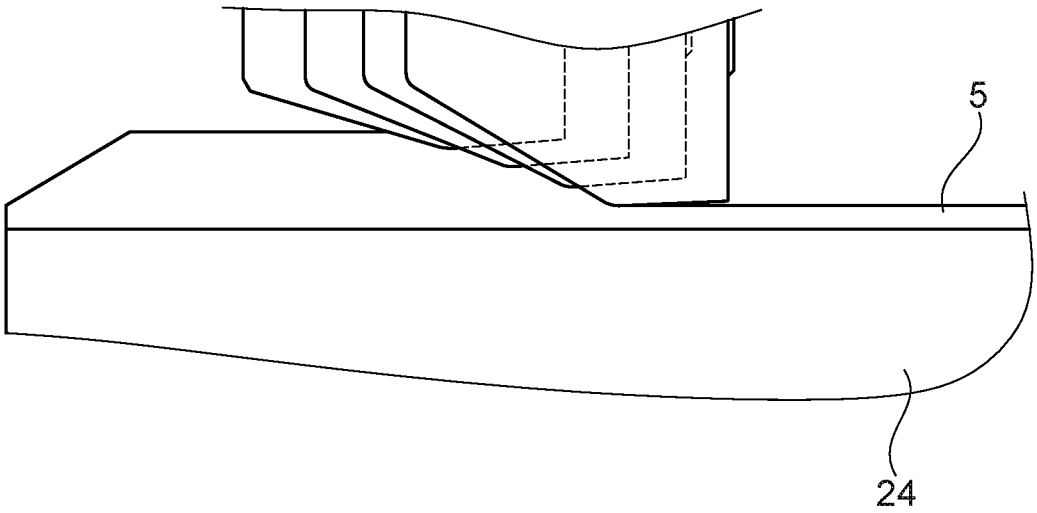
FIG. 6 shows a schematic detailed cross-sectional view in a forming process according to the invention with four spinning rollers.
Figure 7:
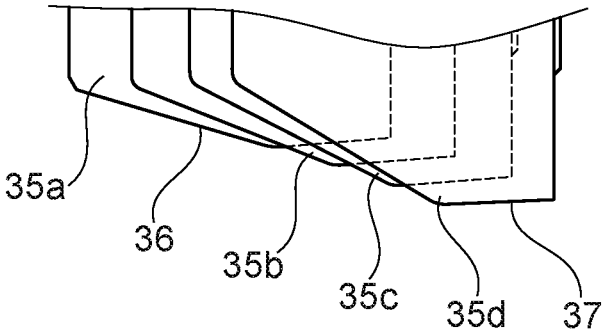
FIG. 7 shows a cross-sectional view only of the spinning rollers of FIG. 6.

In FIGS. 6 and 7 in a different embodiment according to the invention, a forming machine with a total of four spinning rollers 35*a*, 35*b*, 35*c* and 35*d* is schematically shown, which are forming a tubular workpiece 5 on a flow forming mandrel 24. The four spinning rollers 35 are thereby offset by 90° relative to each other around the rotation axis of the flow forming mandrel 24 and arranged distributed around the circumference of the workpiece 5. The individual spinning rollers 35 differ from each other with respect to their axial and radial position, so that the four spinning rollers 35 each perform different forming steps.

The first leading spinning roller 35*a* has a leading position in the axial direction and is outer-lying radially. In addition the first spinning roller 35*a* has a conical roller circumferential surface 36 which has, relative to a roller axis that is parallel to the rotation axis of the workpiece 5, a first flat angle of inclination. The positions of the second spinning roller 35*b* and the third spinning roller 35*c* are each further rearwardly offset in axial and radial direction, in order to correspondingly carry out further forming steps. Thereby, the angle of inclination of the roller circumferential surface 36 in each case increases further towards the roller axis.

The fourth and last spinning roller 35*d* is trailing in the axial direction and has the inner-lying position in the radial direction, which defines the end diameter for the workpiece 5. The run-in angle of the fourth spinning roller 35*d* is most inclined relative to the roller axis, in order to perform desired flow forming and material displacement. Each of the spinning rollers is also provided with a free surface 37. This ensures smoothing-out of the outgoing material surface.

Depending on the material to be formed, the transition from the roller circumferential surface 36 to the free surface 37 is provided with a more or less large radius. Very large radii can thereby also replace the conical surface 36.

The support 30 is preferably designed as a frame construction in order to be able to reliably absorb the high forming forces. The necessary axial offset of the spinning rollers 35 can be preferably set manually via adjusting spindles and/or displaceable roller bearings. An automatic roller-axial displacement is also provided, which facilitates a displacement of the rollers and respectively the axial offset in the process and/or under load.

A further preferred embodiment uses the existing axial feed drives of the support. A multi-part design of the support is thereby then used which parts, in turn, are interconnected via axial guides.

It is also conceivable to use an additional stabilisation frame, which moves with a slight axial offset, which absorbs the forces of the radial units with spinning rollers indirectly via the machine frame and thus stabilises the machine frame against springing in an increasing manner.

The invention claimed is:

1. A forming machine for spinning/flow forming of a workpiece, having
- a machine bed,
- a headstock,
- a main spindle rotatably mounted on the headstock, with a flow forming mandrel which is provided to receive the workpiece,
- a support which carries at least one machining tool and which is axially displaceable relative to the main spindle in a longitudinal direction of the machine bed,
- a main spindle drive for driving in rotation the main spindle, and
- a feed drive for displacing the support, wherein
- the main spindle drive has at least two drive motors, each with a drive pinion, and
- the main spindle has at least one driving gear, which is driven by the drive pinions of the drive motors.

2. A forming machine according to claim 1, wherein
- the drive pinions and/or the drive motors are arranged symmetrically to the driving gear of the main spindle.

3. A forming machine according to claim 1, wherein
- the drive pinions are each arranged on a motor output shaft of the corresponding drive motor, and
- the drive pinions are in direct engagement with the driving gear of the main spindle.

4. A forming machine according to claim 1, wherein
- the drive motors are designed as slow rotating motors including three-phase asynchronous motors.

5. A forming machine according to claim 1, wherein
- the feed drive has a plurality of drive units which can be operated in a gantry operation.

6. A forming machine according to claim 5, wherein
- at least four drive units are provided.

7. A forming machine according to claim 5, wherein
- the drive units are formed to be the same.

8. A forming machine according to claim 5, wherein
- the drive units are arranged symmetrically around a machine axis of the forming machine.

9. A forming machine according to claim 5, wherein
- the drive units each have a ball screw spindle and the ball screw spindles are arranged parallel to each other.

10. A forming machine according to claim 9, wherein
- at least one ball screw spindle is formed in multiple parts,
- a first part of the ball screw spindle is arranged in a loaded work area and a second, smaller part of the ball screw spindle in an unloaded work area, and
- the second part of the ball screw spindle can be prestressed to support the first part of the ball screw spindle.

11. A forming machine according to claim 9, wherein
- for the position control and/or position regulation of the support and/or main spindle, a rotary encoder is arranged on the headstock on the second part of the ball screw spindle.

12. A forming machine according to claim 9, wherein
- to support at least one ball screw spindle, a calotte support is provided.

13. A forming machine according to claim 1, wherein
- the flow forming mandrel can be connected with positive locking to the main spindle.

14. A forming machine according to claim 13, wherein
- the positive locking connection between the flow forming mandrel and main spindle is configured as a Hirth toothing.

15. A forming machine according to claim 1, wherein
- an ejecting means with a press head and a tailstock with a contact pressure extension are provided, by means of which the flow forming mandrel can be tensioned onto the main spindle.

16. A forming machine according to claim 1, wherein
- a tailstock is provided with a tailstock spindle,
- a rotational speed synchronisation can be set between the main spindle and tailstock spindle, and
- the rotational speed synchronisation can be converted to a torque-controlled operation.

17. A forming machine according to claim 1, wherein
- spinning rollers and/or radial units of the support are mounted so that they can be adjusted relative to each other, and
- the spinning rollers and/or the radial units can be adjusted axially under load by means of an actuator.

18. A method for spinning/flow forming of a workpiece, with a forming machine according to claim 1, wherein
- the workpiece is arranged on a flow forming mandrel fixed on a main spindle,
- the main spindle is driven by a main spindle drive, and
- a support, on which at least one machining tool is arranged, is moved relative to the flow forming mandrel for the spinning/flow forming of the workpiece, wherein
- the main spindle drive has at least two drive motors, each having a drive pinion, and the main spindle has a driving gear, which is driven by the drive pinions of the drive motors.

19. A method according to claim 18, wherein
- the support and/or the headstock is/are moved by means of a plurality of drive units, which are operated in a gantry assembly.

20. A method according to claim 18, wherein
- the finished workpiece is pushed with an ejecting means and/or a stripper unit from the tool mandrel.

* * * * *